US007126465B2

(12) United States Patent
Faltesek

(10) Patent No.: US 7,126,465 B2
(45) Date of Patent: Oct. 24, 2006

(54) MONITORING SYSTEM AND METHOD

(75) Inventor: Anthony E. Faltesek, Roseville, MN (US)

(73) Assignee: Honeywell International, Inc., Morristown, NJ (US)

( * ) Notice: Subject to any disclaimer, the term of this patent is extended or adjusted under 35 U.S.C. 154(b) by 79 days.

(21) Appl. No.: 10/714,709

(22) Filed: Nov. 17, 2003

(65) Prior Publication Data

US 2005/0104724 A1 May 19, 2005

(51) Int. Cl.
*G08B 23/00* (2006.01)

(52) U.S. Cl. ..... 340/500; 340/506; 340/511; 340/539.1; 340/3.1

(58) Field of Classification Search ..... 340/500, 340/506, 511, 539.1, 3.1
See application file for complete search history.

(56) References Cited

U.S. PATENT DOCUMENTS 5,400,246 A 3/1995 Wilson et al. ..... 700/17

*Primary Examiner*—Daryl C Pope
(74) *Attorney, Agent, or Firm*—Welsh & Katz, Ltd.

(57) ABSTRACT

An apparatus and method monitor the operational status of one or more other systems or components. Each of the other systems has a primary operational function such as message repeating, environmental control, hazardous condition monitoring or regional security. The systems or components feedback information as to their functionality to the apparatus for analysis and presentation.

14 Claims, 2 Drawing Sheets

MONITORING SYSTEM AND METHOD

FIELD OF THE INVENTION

The invention pertains to monitors of systems, which are intended to carry out predetermined functions. More particularly, the invention pertains to monitors of the operationality of communications systems, fire alarm systems, building control systems and the like.

BACKGROUND

Structures which contain business or industrial facilities such as offices, warehouses and the like, as well as multiple unit residential buildings, usually include a variety of building wide types of systems to provide a variety of services to the individuals present in the respective structures. These include environmental control systems such as heating and air conditioning, water supply, electrical systems, lighting systems, and the like. Additional types of systems include environmental monitoring systems such as fire alarm systems, gas detection systems, security systems, as well as various types of radio and video repeater systems for the purpose of improving communications within the respective facilities.

Knowledge of the operation of the status of the above types of systems is particularly useful and important not only for facility management, but also for first responders in the event of a fire, electrical or other emergency on the premises. It would thus be desirable to be able to quickly ascertain the operational functionality of various service providing systems within the facility. Preferably such information could be brought together and provided at a centralized location readily accessible not only by facility management, but also by the first responders.

There continues to be a need for such a system monitoring equipment not only for new construction, but also as upgrades to existing systems in previously constructed facilities. Preferably installation of such monitoring systems could be achieved cost effectively without major reconstruction or modeling of the respective facilities.

DESCRIPTION OF THE PREFERRED EMBODIMENTS

Figure 1:
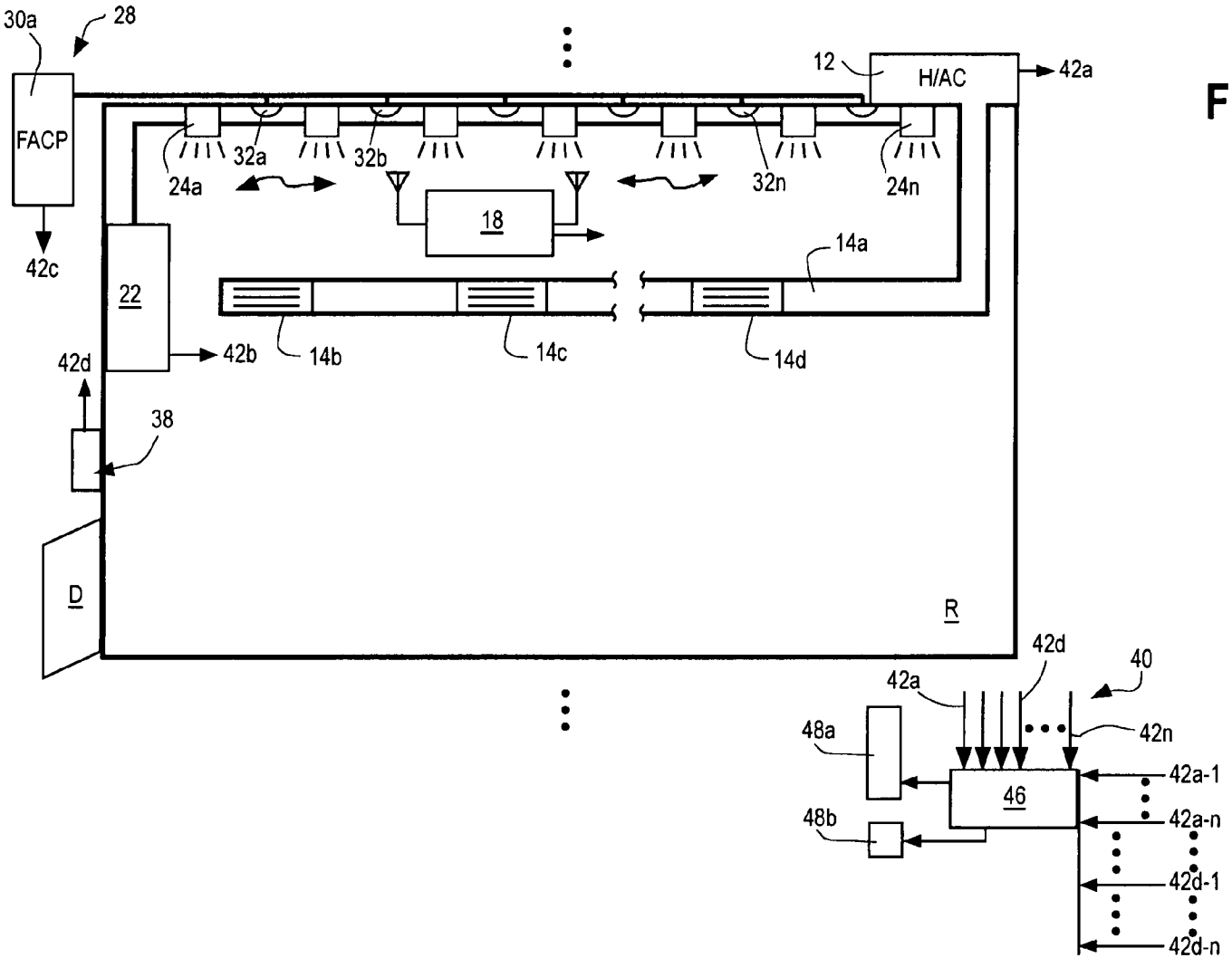
FIG. 1 is a block diagram of a Region R with systems being monitored in accordance with the invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

In accordance with the invention, plurality of monitoring elements can be coupled to different types of systems present in a region. The region could be for example one floor or could be a multiple floor structure.

Each of the monitoring elements is coupled to and monitors the functionality of one of the systems, or a subsystem, which provides predetermined service in and to the region. For example, elements could monitor the operationality of fire alarm system, a lighting control system, a wireless repeater system, a regional security system or heating/air conditioning system which services the region. Signals indicative of the operational status of the various systems being monitored are brought to a common control unit presented. There the functionality indicating feedback information could be presented audibly or visually, such as via synthetic speech, a display or by hard copy. The monitoring elements provide, in a disclosed embodiment, periodic indicia of the functionality of the respective system, or subsystem.

In one disclosed embodiment, a predetermined signal can be provided at periodic intervals indicative of the proper operation of the system being monitored. For example, an electrical sequence, such as a pulse train can periodically be provided to a predetermined, location indicative of the proper operation of regional security system or regional fire alarm system. The same could be provided for the regional fire control system, wireless repeating system or heating/air conditioning system. Separate signals can be provided for subsystems or components.

The periodically appearing signals provide a current, recurring, indicator that the respective system, subsystem or component is functioning as expected. In the absence of the appropriate signal, an audible or visible indicator could be provided at the common predetermined monitoring unit indicative of a system, subsystem or component failure. The appropriate system could then be evaluated to determine its functionality. Necessary repairs or changes could be expeditiously carried out.

In an emergency condition, such as after a fire has been detected and the fire alarm system has gone into alarm, the display at the common location can be consulted to determine the status of other major systems in the region given the ongoing fire condition. For example proper functionality indicated feedback signals from the radio repeater system could provide first responders an indication that the region could be entered without expecting to lose communications capability. Alternately, if the heating/air conditioning system continues to function properly notwithstanding the presence of the fire alarm, first responders could expect that system might be useable to help clear smoke from the region. In the event that the monitoring equipment indicates that one or more major regional systems has failed the first responders or maintenance personnel will be able to specifically and immediately identify the system or systems which can not be relied upon or used absent maintenance or repair.

An embodiment of the present invention is disclosed in FIG. 1 in association with a Region R, which is shown in a side sectional view. It will be understood that the Region R could include a plurality of floors all without limitation and without departing from the spirit and sculpt of the present invention. Region R could represent a residential, commercial or industrial facility without limitation.

Region R includes a variety of major service providing systems as would be understood by those of skill in the art. These include, heating/air conditioning system 12 coupled to ducts 14*a* as well as inflow/outflow registers or the like 14*b c* and *d* all without limitation.

Region R could also include an exemplary radio repeater system 18 to facilitate communications throughout the region as well as with the exterior thereof. Region R might also include a lighting control system 22 which is in turn coupled to a plurality of lights such as fluorescent fixtures of the like, all without limitation, 24*a b c . . . n*.

Further, Region R might be monitored by a fire alarm system indicated generally at 28. System 28 might include a fire alarm control panel 30*a* which is in turn coupled via a wired or wireless medium to a plurality of smoke, flame, thermal or gas detectors 32*a* 32*b* . . . 32*n* all without limitation.

Finally, Region R might be monitored with a security monitoring system indicated generally at 38. System 38 might include sensors to track the opening and closing of one or more doors to control access into Region R and the like as would be understood by those of skill in the art.

All of the above noted systems including heating/air conditioning system 12, wireless repeater system 18, lighting control system 22, fire alarm system 28 as well as security system 38 could, as would be understood by those of skill in the art, have control or display panels all located at a common location to facilitate the efficient and safe operation of the activities in the Region R especially in the presence of individuals who might be living or working therein.

In accordance herewith, regional system monitoring equipment 40 is coupled to and receives signals from each of the major systems 12, 18, 22, 28 and 38. These feedback signals are indicated generally at 42*a b c* . . . *n*. It would be understood that neither the number nor the exact nature of the signals 42*a, b, c* . . . *n* are limitations of the present invention. The subject signals can be presented as modulated tones, pulses, levels or other forms electrical signals all without limitation. The signals 42*a b c* . . . *n* are bought to a common monitoring unit 46 which could be implemented for example as a programmed computer. The unit 46 could but need not be located in the same vicinity as the displays, control panels and control devices or computers for the regional systems 12, 22, 28 and 38 all without limitation.

System 40 periodically receives signals 42*a, b, c* . . . *n* which are indicative of the operational status of the major systems 12, 22, 28 and 38. This information can be presented graphically on display 48*a* or audibly via output transducer 48*b*. The operational indicating indicia whether on display 48*a* or output audibly via transducer 48*b* can be periodically updated based on received signals 42*a*, 42*b* . . . 42*n*.

Maintenance personnel, security personnel or first responders arriving at the scene of an alarm condition such as a failed heating/air conditioning system or an active fire alarm system, could consult the output indicia presented by system 40 to ascertain the functionality of the various systems 12, 22, 28 and 38 prior to entering into the Region R.

The system 40 thus could be located adjacent to but outside of the Region R whereas some or all of the respective systems 12, 22, 28 and 38 might be located within the Region R and substantially unaccessible in the presence of an adverse or alarm condition.

It will also be understood that in addition to the various major systems, such as heating and air conditioning unit 12, transmitting functionality indicating signals to the system 40, those respective signals can be transmitted to or by various subsystems or components of the heating/air conditioning system 12 such as heating or cooling equipment therein, fans, compressors and the like. Those respective subsystems, individual devices or components can in turn provide additional, supplemental, signals to system 40 indicative of the operational characteristics of various subsystems of the heating/air conditioning system 12. These signals, indicative of subsystem or component operationality, indicated generally as 42*a*-1, -2 . . . -*n* . . . 42*d*-1, -2, -3 . . . -*m* can provide functionality information as to various subsystems or components which make up systems in the Region R.

Similar signals can be fed back from subsystems or components of the lighting control system 22, fire alarm system 28 or security system 38 all without limitation. These supplemental, subsystem or component related signals can in turn be presented on output devices 48*a, b* to security personnel, maintenance personnel or first responders as to status of the various subsystems or components.

By using information presented on output devices 48*a, b* appropriate security, maintenance personnel or first responders have available information concerning the functionality and operationality of the major systems such as 12, 22, 28 and 38 as well as associated subsystems or components without having to enter into the Region R. This in turn can be used to assess how best to proceed to respond to the ongoing condition.

It will also be understood that systems such as the system 40 can be installed initially during the new construction phase of a building or Region R. Alternately, it can be added on after the fact as desired or required.

Figure 2:
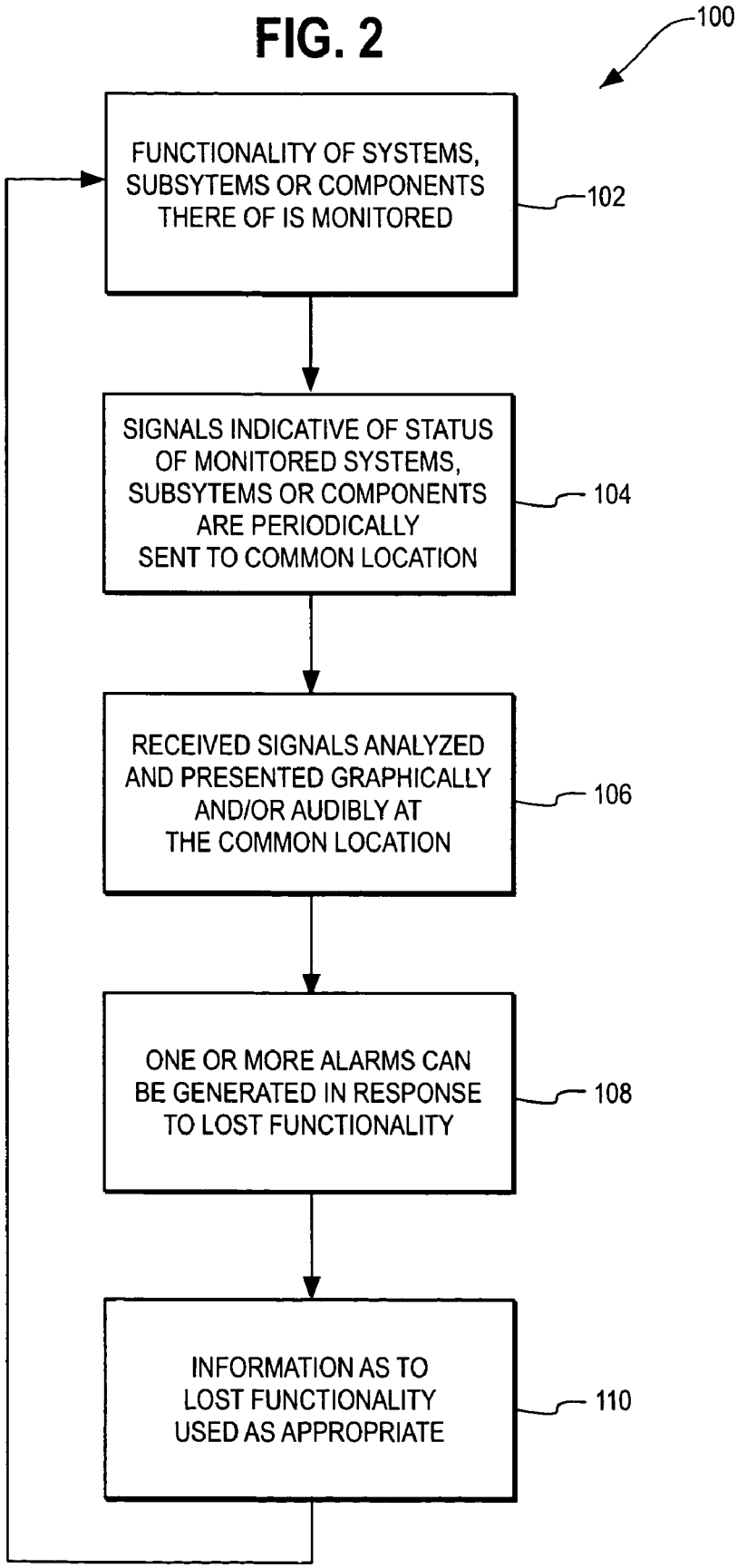
FIG. 2 is a flow diagram of a method in accordance with the invention.

FIG. 2 illustrates a flow diagram of a monitoring method 100 in accordance with the invention. In step 102 the functionality of systems, subsystems or components servicing a region can be monitored. In step 104 electrical signals indicative of system, subsystem or component functionality are periodically transferred into a common location.

In step 106 the received signals were analyzed and presented visually or audibly, or both, at the common location. In a step 110 one or more visual or audible alarms can be generated in response to lost functionality indicated by either missing signals or signals indicative of non-functionality of various systems, subsystems or components. In a step 110 information as to lost functionality can be used for maintenance or other purposes as needed.

In accordance with the invention, other types of systems, without limitation, can also be monitored. Exemplary additional or alternative types of systems are described subsequently.

Building utilities are both general use and specialized systems that delivery energy or substances to various parts of buildings. Common building utilities include electrical service and distribution, and natural gas distribution. In emergencies, both of these utilities can present dangers. A live electrical feed can make a fire larger, or hotter, and more difficult to extinguish. A natural gas feed can also make a fire larger, hotter, and much more difficult to extinguish.

For example, if an electrical distribution system is monitored and a sudden increase in electrical draw is reported near the suspected time of the start of an emergency, it can be concluded that there may be something wrong with that electrical distribution system. It may be experiencing sudden and excessive draw because it failed, and as a result, has also started the emergency. It may also be that the emergency quickly affected the electrical system, and as a result, the damage incurred has caused partial failure, and excessive draw. Since the location of the excessive draw should be known as part of the utility monitoring, an incident commander, in cooperation with building personnel, can assess the risk to fire fighters of entering the areas affected by the system.

System monitoring could be based on, but would not be limited to, many accepted methods of monitoring systems now used in sophisticated building and industrial control systems. Specific indicators could be chosen for a utility, and then be monitored for the purpose of assessing utility health. An even more sophisticated situation awareness component could be used to evaluate whether the performance of various building utilities is significantly deviating from the norm, or whether a trend in one or more of the monitored indicators could show abnormal behavior in those systems, and the possibility of a developing incident or emergency.

Building utilities could also be monitored to help assure a building's well being. A list of such utilities follows. The suggested indicators are not exhaustive but are exemplary of such possible indicators.

Electrical: Indicators of sudden increases in draw, or indications of faults to ground.

Natural Gas: Indicators of sudden flows of gas, or flows higher than normal usage.

Oxygen: Indicators of sudden flows of gas, or flows higher than normal usage would indicate.

Hydrogen: Indicators of sudden flows of gas, or flows higher than normal usage would indicate.

Fuel Oil: Indicators of sudden flows of oil, or flows higher than normal usage would indicate, or flows that should not be occurring because of an ordered shutdown.

Nitrogen: Indicators of sudden flows of gas or liquid, or flows higher than normal usage would indicate, or sensors showing abnormally low oxygen levels in monitored spaces.

Acids: Indicators of sudden flows of acid, or flows higher than normal usage would indicate, or indications of deteriorating air quality in monitored spaces.

Solvents: Indicators of sudden flows of solvent, or flows higher than normal usage.

Coal Feeds: An indication of a coal feed that has failed could be boilers that sudden go out of balance from too little or too much fuel.

The system could map the building utility(s) with indications of the locations of cutoff devices such as switches, and valves. The system could indicate where the likely location of the emergency is, and where the system can be shut off to the areas affected by the emergency with the least disruptive impact on the remaining portion of the utility system.

Such monitoring can also be used to improve building function or machinery function. The sensors that would be placed to monitor an electrical distribution system could also be used to monitor electrical draws in much greater detail and accuracy than is usually available to building management. Such detailed and accurate information is the most important part of creating strategies to reduce energy use, or to improve the performance of building utilities or the building or production equipment served. Detailed and accurate information about the energy or substances delivered to areas of a building, or building or industrial equipment is often quite rare, and can be very valuable. It will be understood that other types of products and/or delivery systems, such as cooking oils, or petrochemical products or delivery systems therefore, without limitation could also be monitored within the spirit and scope of the invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. An apparatus comprising:

at least one of, a regional monitoring system with a plurality of spaced apart detectors for monitoring conditions in a region, a wireless communications repeating system, a building environmental control system, a lighting control system, a security system, a fuel distribution system, a petrochemical distribution system, a hazardous material distribution system, or a selected component associated with one of a selected system or subsystem;

a plurality of elements for monitoring operation of different portions of the at least one system each of the elements emits a first discontinuous signal in response to the respective portion of the at least one system exhibiting a normal operational mode and a second, different electrical signal in response to the respective portion for the at least one system exhibiting an abnormal operational mode; and a common control unit coupled to the elements and responsive to the first and second signals received from at least some of the elements.

2. An apparatus as in claim 1 including a graphical display coupled to and driven from the control unit thereby providing visual indicators of functional operation of the different portions of the at least one system.

3. An apparatus as in claim 2 where the control unit includes executable instructions for formatting the visual indicators.

4. An apparatus comprising:

at least one system selected from a class which includes at least a fire alarm system, an illumination control system, a heating ventilating air conditioning system, a security system, an electrical supply system, a gas supply system, a fluid supply system and a solid material supply system;

at least one monitoring module coupled to a selected portion of the system, the module monitors the operation of at least the selected portion of the system and determines if the selected portion is operating in accordance with a predetermined, expected operational criteria, the module including circuitry that generates periodic electrical signals in response to a determination that the selected portion is operating in accordance with the predetermined, expected operational criteria.

5. An apparatus as in claim 4 which includes first circuitry which receives the periodic electrical signals and which provides an indicator thereof.

6. An apparatus as in claim 5 where the first circuitry presents an indicium of normal operation of the selected portion in response to received periodic electrical signals.

7. An apparatus as in claim 5 where the first circuitry presents an indicium of abnormal operation in response to a failure to receive periodic electrical signals.

8. An apparatus as in claim 6 where the first circuitry presents the indicium by at least one of visually presenting a representation thereof, or, audibly presenting a representation thereof.

9. An apparatus as in claim 4 where the periodic electrical signals generated by the module are in addition to operational electrical signals present in the portion of the system being monitored.

10. An apparatus as in claim 9 where the system comprises a fire alarm system and the monitoring module monitors the operation thereof and generates the periodic electrical signals in response to normal operation thereof.

11. An apparatus as in claim 10 which includes as a second system at least one of an illumination control system, a wireless repeating system, a heating ventilating air conditioning system and a security system; and a second monitoring module coupled to a selected portion of the second system, the second module monitors the operation of a least the selected portion of the second system and determines if the selected portion of the second system is operating in accordance with a second predetermined, expected operating criteria, the second module including circuitry that generates periodic electrical signals in response to a determination that the selected portion of the second system is operating in accordance with the predetermined, expected operational criteria where the first circuitry presents an indicium of normal operation in response to received periodic electrical signals.

12. An apparatus as in claim 6 which includes a plurality of monitoring modules, each of the modules is coupled to a respective portion of the system, each respective module monitors the operation of at least the selected portion of the system and determines if the selected portion is operating in accordance with a predetermined, expected operational criteria, the module including circuitry that generates periodic electrical signals in response to a determination that the selected portion is operating in accordance with the predetermined, expected operational criteria.

13. An apparatus as in claim 12 where monitoring modules can be selected from a class which includes at least a monitor of electrical current draw, a monitor of gas flow, a monitor of oil flow, a monitor of acid flow, a monitor of solvent flow and a monitor of coal feed.

14. An apparatus as in claim 13 where the monitor of electric current responds to predetermined increases in current draw, the monitor of gas flow responds to predetermined increases in gas flow, the monitor of oil flow responds to predetermined increases in oil flow, the monitor of acid flow responds to predetermined increases in acid flow, the monitor of solvent responds to predetermined increases in solvent flow and the monitor of coal feed responds to a predetermined variation from an expected coal feed.

* * * * *